US009253851B2

(12) United States Patent
Hoffer, Jr. et al.

(10) Patent No.: US 9,253,851 B2
(45) Date of Patent: Feb. 2, 2016

(54) AUTO CONFIGURING RUNWAY LIGHTING SYSTEM

(71) Applicants: John Michael Hoffer, Jr., Bel Air, MD (US); Sean Xiaolu Wang, Wilmington, DE (US)

(72) Inventors: John Michael Hoffer, Jr., Bel Air, MD (US); Sean Xiaolu Wang, Wilmington, DE (US)

(73) Assignee: BWT Property, Inc., Newark, DE (US)

( * ) Notice: Subject to any disclaimer, the term of this patent is extended or adjusted under 35 U.S.C. 154(b) by 594 days.

(21) Appl. No.: 13/686,956

(22) Filed: Nov. 28, 2012

(65) Prior Publication Data

US 2013/0147389 A1 Jun. 13, 2013

Related U.S. Application Data

(60) Provisional application No. 61/569,388, filed on Dec. 12, 2011.

(51) Int. Cl.
*H05B 37/00* (2006.01)
*H05B 37/02* (2006.01)

(52) U.S. Cl.
CPC ..... *H05B 37/02* (2013.01); *H05B 37/0272* (2013.01)

(58) Field of Classification Search
CPC combination set(s) only.
See application file for complete search history.

(56) References Cited

U.S. PATENT DOCUMENTS

| | | | | |
|---|---|---|---|---|
| 7,357,530 | B2 | 4/2008 | Wang et al. | |
| 7,378,983 | B2 | 5/2008 | Wang et al. | |
| 7,497,593 | B2 | 3/2009 | Wang | |
| 7,659,676 | B2 * | 2/2010 | Hwang | 315/360 |
| 7,755,513 | B2 | 7/2010 | Wang et al. | |
| 7,798,669 | B2 * | 9/2010 | Trojanowski et al. | 362/208 |
| 7,804,251 | B2 * | 9/2010 | Wang | 315/133 |
| 8,514,095 | B2 * | 8/2013 | Greer et al. | 340/815.45 |
| 8,816,842 | B2 * | 8/2014 | Gookin | 340/468 |
| 2005/0110649 | A1 * | 5/2005 | Fredericks et al. | 340/815.45 |
| 2007/0081331 | A1 * | 4/2007 | Wang | 362/250 |

* cited by examiner

*Primary Examiner* — Douglas W Owens
*Assistant Examiner* — Monica C King

(57) ABSTRACT

This invention relates to an auto configuring runway lighting system. The auto configuring runway lighting system comprises a plurality of lighting apparatus. Each lighting apparatus comprises a means for determining geographic location information of the lighting apparatus. A central controller communicates with the plurality of lighting apparatus to obtain the geographic location information and controls the status of the plurality of lighting apparatus based on the geographic location information.

2 Claims, 2 Drawing Sheets

AUTO CONFIGURING RUNWAY LIGHTING SYSTEM

REFERENCE TO RELATED APPLICATION

This application claims an invention which was disclosed in Provisional Patent Application No. 61/569,388, filed Dec. 12, 2011, entitled "AUTO CONFIGURING RUNWAY LIGHTING SYSTEM". The benefit under 35 USC §119(e) of the above mentioned United States Provisional Applications is hereby claimed, and the aforementioned applications are hereby incorporated herein by reference.

FIELD OF THE INVENTION

This invention generally relates to a runway lighting system, and more specifically to an auto configuring runway lighting system.

BACKGROUND

Lighting systems are important navigational aids for aircrafts, boats, or other vehicles, in providing guidance, signaling, and demarcation functions therefore. In certain military or emergency navigation applications, the lighting system is required to be reconfigurable, such as changing the number of runway, taxiway, threshold, runway end and obstruction lights according to momentary needs. It is also desirable to have sensor units embedded in the lighting apparatus for automatically controlling their operation according to their geographic locations.

U.S. Pat. No. 7,659,676 issued to Hwang discloses a lighting system which includes a GPS receiver for calculating sunrise time and sunset time from an inputted GPS signal and outputting an on/off signal according to the calculated sunrise time and sunset time, and a security light configured to be turned on/off in response to the on/off signal.

U.S. Pat. No. 7,798,669 issued to Trojanowski et al. discloses a remotely adjustable lighting device configured to an operational mode customized for the geographic location of the device. The lighting device is powered by a battery provided with solar charging. The lighting device is turned off and on for an illumination period as a function of both local sunrise and sunset times determined by a combination of time and date information and GPS positioning.

None of the above cited patents addresses the issue of automatically reconfiguring a runway lighting system according to momentary military or emergency navigational needs.

SUMMARY OF THE INVENTION

It is the overall goal of the present invention to provide an auto configuring runway lighting system. The auto configuring runway lighting system comprises a plurality of lighting apparatus. Each lighting apparatus comprises a means for determining geographic location information of the lighting apparatus. A central controller communicates with the plurality of lighting apparatus to obtain the geographic location information and controls the status of the plurality of lighting apparatus based on the geographic location information.

BRIEF DESCRIPTION OF THE FIGURES

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
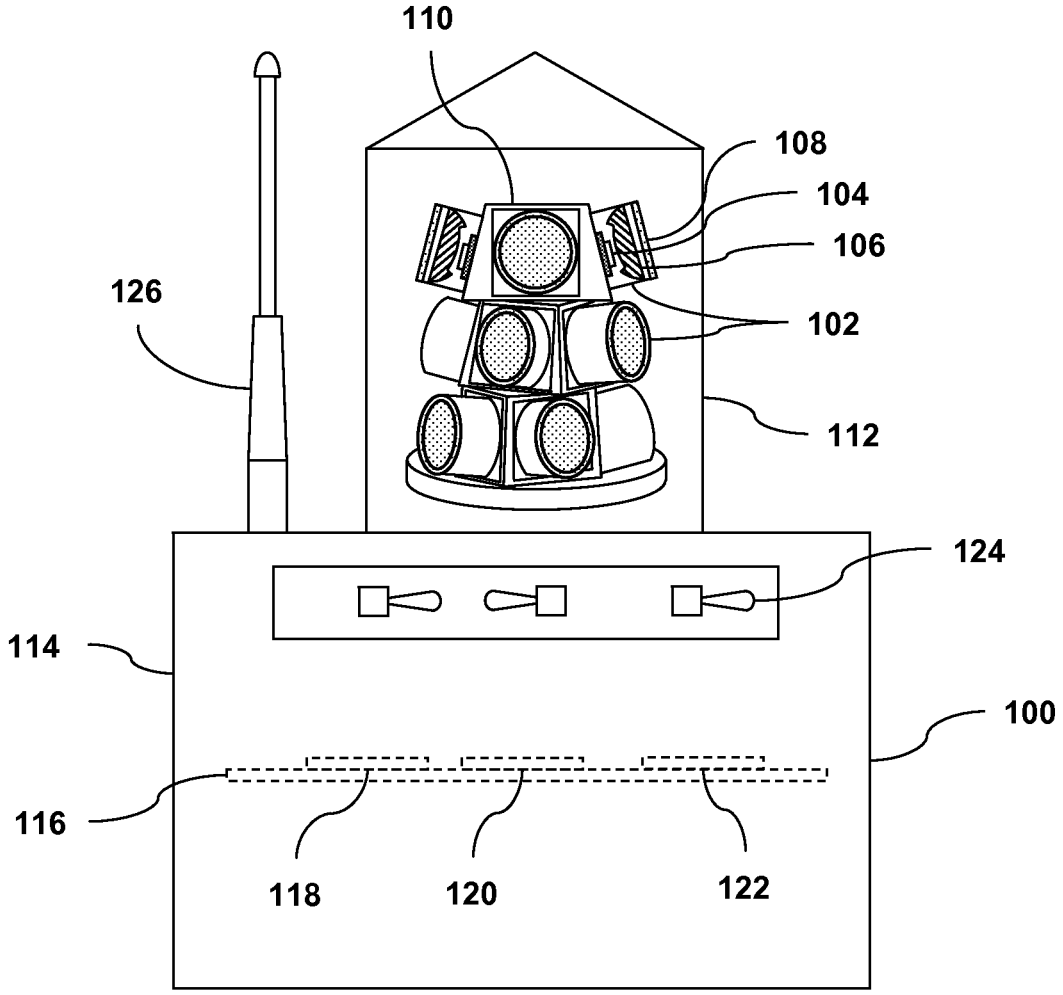
FIG. 1 illustrates the structure of an exemplary light emitting diode (LED) lighting apparatus.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of method steps and apparatus components related to an auto configuring runway lighting system. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

The structure of an exemplary airport lighting apparatus 100 is illustrated in FIG. 1. The lighting apparatus 100 produces an omnidirectional light beam which is used as elevated airport runway edge light. The lighting apparatus 100 comprises twelve high intensity light emitting diode (LED) units 102 mounted in three vertically adjacent stacks. Each stack comprises four LED units separated by ninety degrees (90°) angularly in the horizontal plane. An angular offset of thirty degrees (30°) in the clockwise direction is introduced between adjacent LED stacks for more uniform illumination. Each LED unit 102 comprises a surface mounted, or in other words, chip-on-board (COB) packaged high intensity visible LED chip 104 mounted on a metal or ceramic heat sink. A non-imaging lens 106 is employed to collect and collimate the light beam produced by the LED chip 104. A thin film holographic diffuser 108 following the non-imaging lens 106 is used to homogenize the light beam and to control its divergence angle. The LED units 102 in each stack are mounted on the outer side of a square-shaped metal fixture 110 for heat dissipation. The slope angle of the metal fixture 110 defines the elevation angle of the LED units 102, which may be custom designed according to different navigation requirements. The high output intensity of the COB LED chip 104, in combination with the high light collection efficiency of the non-imaging lens 106, and the high transmittance of the holographic diffuser 108, results in a high luminous intensity for the LED lighting apparatus 100. The luminous intensity can be further enhanced by simply incorporating more LED units or employing LEDs with higher output intensity. The entire LED module is enclosed in a waterproof transparent housing 112. Below the transparent housing 112 is an electrical compartment 114 that holds the LED driver circuit board 116, which further comprises a micro-controller 118, a wireless transceiver 120, and a global positioning system (GPS) chip 122. The intensity, flash pattern, and on/off status of the LED units 102 can be controlled manually by a set of switches 124 or by wireless communication with a remote central controller through the wireless transceiver 120 and an antenna 126. A more detailed description of the LED lighting apparatus can be found in U.S. Pat. No. 7,804,251, the disclosure of which is incorporated herein by reference.

Figure 2:
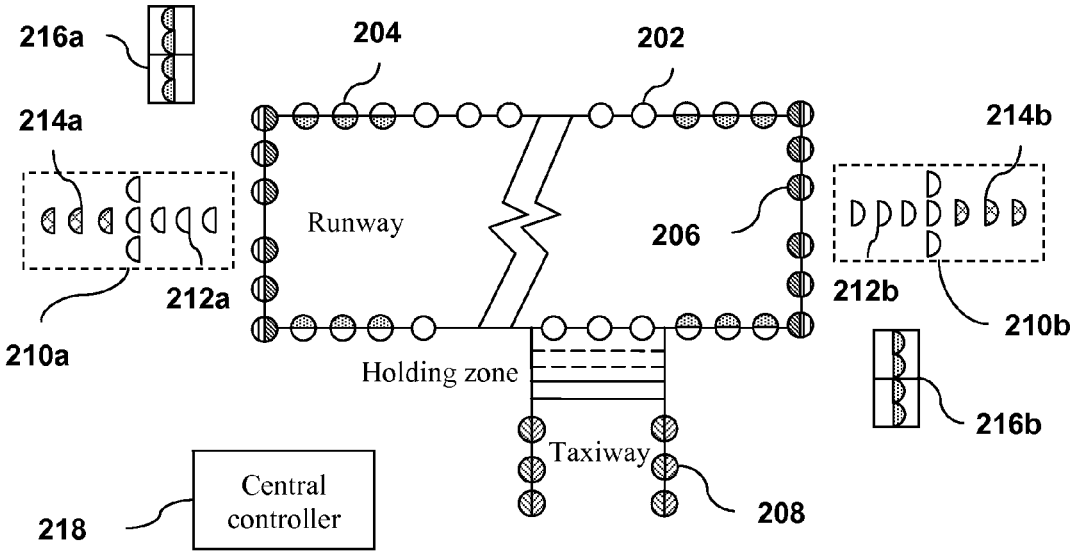
FIG. 2 illustrates one exemplary auto configuring runway lighting system based on the LED lighting apparatus of FIG. 1.

The modular design of the LED lighting apparatus 100 makes it easily reconfigurable and upgradeable to adapt for different navigational needs. FIG. 2 shows an exemplary auto configuring runway lighting system constructed on the basis of the LED lighting apparatus of FIG. 1. The runway lighting system comprises various types of lighting apparatus, including omnidirectional white runway edge lights 202, bidirectional white/yellow runway edge lights 204, bidirectional red/green runway threshold/end lights 206, omnidirectional blue/red taxiway edge lights/obstruction lights 208, unidirectional precision approach path indicators (PAPIs) 216*a* and 216*b*, and unidirectional approach lights 210*a* and 210*b*, which are composed of steady-burning white lights 212*a* and 212*b* and flashing white lights 214*a* and 214*b*, respectively. A central controller 218 controls the status of each lighting apparatus through wireless connections. Each of the lighting apparatus in FIG. 2 has a structure similar to the lighting apparatus 100 of FIG. 1 except that the angular orientation, the divergence angle, and the relative position or the spatial distribution of the LED units is reconfigured to produce the desired illumination pattern. The divergence angle of the LED unit is controlled by the non-imaging collimation lens and the view angle of the holographic diffuser. The luminous intensity of the LED lighting apparatus can range from a few tens of candelas to several thousand or even tens of thousands candelas by controlling the number and type of LED units employed in the lighting apparatus. LED units in different wavelengths (colors) and/or flash patterns can be integrated into the same lighting apparatus with their operation status independently controlled by the micro-controller for reconfiguration of the navigational lights.

The omnidirectional white runway edge light 202 comprises twelve high intensity white LED units mounted vertically in three stacks with four LED units in each stack. The LED units are arranged with different angular orientations in a way similar to that shown in FIG. 1 to form a 360° omnidirectional illumination in the horizontal plane. The bidirectional white/yellow runway edge light 204 comprises one group of high intensity white LED units and one group of high intensity yellow LED units with their light beams facing opposite directions. Each LED group comprises six LED units mounted vertically in three stacks with two LED units in each stack. The adjacent LED stacks are shifted by thirty degrees (30°) in their angular orientation for more uniform illumination. The beam of each LED unit is controlled by a non-imaging lens and a holographic diffuser so that both the white LED units and the yellow LED units cover a 180° illumination angle in their respective illumination direction. The omnidirectional blue/red taxiway edge light/obstruction light 208 has similar LED layout as does the omnidirectional white runway edge light 202. Yet the intensity of the LED units is relatively lower. The taxiway edge light/obstruction light 208 comprises six blue LED units and six red LED units mounted vertically in three stacks with two blue LED units 211 and two red LED units 213 in each stack. The blue and red LED units in each stack are arranged in an interleaved manner so that both the blue and red light cover a 360° illumination angle in the horizontal plane. The LED units used in the bidirectional runway threshold/end light 206 and the unidirectional approach light 210*a*/210*b* are collimated LED units with no diffusers. They provide directional illumination in a small solid angle. The runway threshold/end light 206 comprise one group of high intensity red LED units and one group of high intensity green LED units with their light beams facing opposite directions. Each LED group comprises six LED units mounted vertically in three stacks with two LED units in each stack. Both the steady-burning light 212*a*/212*b* and the flashing light 214*a*/214*b* of the approach light 210*a*/210*b* comprise six high intensity white LED units mounted vertically in three stacks with two LED units in each stack. The LED units of the steady-burning light 212*a*/212*b* operate in a continuous mode, while the LED units of the flashing light 214*a*/214*b* operate in an intensity-modulated mode. The PAPI 216*a*/216*b* comprises four LED lights, each consisting of one red LED array on the top layer and one white LED array on the bottom layer. The light beams produced by the two LED arrays are both collimated for unidirectional illumination in the same direction. The elevation angle of the LED beams is utilized to indicate the correct glide slope. The red and white LED beams are separated by a narrow transition zone with a vertical spread angle of <3' (3 minutes of arc). All the LED lighting apparatus in the airfield lighting system may comprise infrared LED units for night vision or thermal imaging based navigation. In this case, the infrared LED units are modulated in light intensity to produce a flash pattern. The function of the lighting apparatus is indicated by the flash pattern, which is set by the frequency and duty cycle of the intensity modulation. The lighting apparatus may be powered by rechargeable batteries for temporary or semi-permanent lighting or it may be powered by standard AC power lines for permanent lighting.

The runway lighting system of FIG. 2 can be reconfigured in light intensity, wavelength (color), and/or flash pattern through the wireless transceiver and the micro-controller embedded in the lighting apparatus. Each of the lighting apparatus comprises a GPS chip for determining its geographic location. The geographic location of the lighting apparatus is then reported to the central controller 218. Based on the reported location information of each lighting apparatus, the central controller 218 obtains an actual geographic layout of the runway lighting system. The signal strength or time-of-flight for a wireless transmission (such as the wireless transmission between the lighting apparatus and the central controller) can also be utilized to determine the geographic location of the lighting apparatus.

The central controller 218 utilizes the location information of each of the lighting apparatus to distinguish and organize them into different function groups (e.g. edge light, threshold/end light, approach light, PAPI, etc.). The status of each function group is then automatically controlled to configure the runway lighting system. As one example, the central controller 218 can change the direction of the runway by switching the color (wavelength) of the threshold/end lights 206 that are located on the two ends of the runway and in the meantime turning on/off the corresponding approach lights 210*a*/210*b* and PAPI lights 216*a*/216*b*. As another example, the central controller 218 can use the location information of the flashing approach lights 214*a*/214*b* to automatically control their flashing order. For example, the one furthest from the threshold/end lights 206 or the steady-burning approach lights 212*a*/212*b* would flash first. The one closest would flash last, etc. As yet another example, the central controller 218 can use the geographic layout of the runway lighting system to determine the direction that the runway is pointed, which in turn automatically establishes the runway number. For example, a runway facing 20 degrees would be assigned as runway 2. The geographic location information can also be used to determine which lights belong to a particular runway when one runway intersects another.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

What is claimed is:

1. An auto configuring runway lighting system, comprising:

(a) a plurality of lighting apparatus, each lighting apparatus comprising a plurality of high intensity LEDs mounted on a metal fixture to produce a plurality of light beams; whereby said metal fixture controls a spatial orientation of each of said plurality of light beams;

a set of optical components with each component coupled to an associated LED among said plurality of high intensity LEDs to control a divergence angle and an intensity distribution of each of said plurality of light beams such that said plurality of light beams combine in a free space according to said spatial orientation, divergence angle, and intensity distribution to produce a predetermined illumination pattern;

a wireless transceiver; and a global positioning system (GPS) device for determining geographic location information of said lighting apparatus; and (b) a remote central controller communicating with said plurality of lighting apparatus through said wireless transceiver to obtain said geographic location information and controlling at least one of a color and a flash pattern of said plurality of lighting apparatus based on said geographic location information.

2. The auto configuring runway lighting system of claim 1, wherein said remote central controller controls a flashing order of said plurality of lighting apparatus based on their geographic location information.

* * * * *